US011110704B2

(12) United States Patent
Goh et al.

(10) Patent No.: US 11,110,704 B2
(45) **Date of Patent: *Sep. 7, 2021**

(54) SELECTIVELY FIRING A FLUID CIRCULATION ELEMENT

(71) Applicant: Hewlett-Packard Development Company, L.P., Spring, TX (US)

(72) Inventors: Guan-Kwee Goh, Vancouver, WA (US); Matthew A Shepherd, Vancouver, WA (US); Mark Mackenzie, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/789,890

(22) Filed: Feb. 13, 2020

(65) Prior Publication Data

US 2020/0180310 A1 Jun. 11, 2020

Related U.S. Application Data

(63) Continuation of application No. 16/067,309, filed as application No. PCT/US2016/030131 on Apr. 29, 2016, now Pat. No. 10,596,814.

(51) Int. Cl.
*B41J 2/14* (2006.01)
*B41J 2/175* (2006.01)

(52) U.S. Cl.
CPC ..... *B41J 2/1404* (2013.01); *B41J 2/14032* (2013.01); *B41J 2/14145* (2013.01); *B41J 2/175* (2013.01); *B41J 2202/12* (2013.01)

(58) Field of Classification Search
CPC .. B41J 2/1404; B41J 2/14032; B41J 2/14145; B41J 2/175; B41J 2202/12
See application file for complete search history.

(56) References Cited

U.S. PATENT DOCUMENTS

| | | | |
|---|---|---|---|
| 8,157,365 | B2 | 4/2012 | Wouters et al. |
| 8,434,857 | B2 | 5/2013 | Falkner et al. |
| 8,814,293 | B2 | 8/2014 | Strunk et al. |

(Continued)

FOREIGN PATENT DOCUMENTS

| | | |
|---|---|---|
| CN | 1626349 | 6/2005 |
| CN | 1953873 | 4/2007 |

(Continued)

OTHER PUBLICATIONS

XAAR, PLC., "TF Technology"—"Delivering unrivalled reliability for industrial inkjet applications"~Dec. 2014~2 pages.

*Primary Examiner* — Julian D Huffman
(74) *Attorney, Agent, or Firm* — Mannava & Kang

(57) ABSTRACT

According to an example, a printing apparatus may include two drop ejecting elements, a fluid circulating element, and a logic device. The logic device may determine whether one or both of a first drop ejecting element and a second drop ejecting element have been fired within a predetermined period of time prior to a current time. In response to the determination, the logic device may selectively transmit an output signal that is to cause the fluid circulating element to be selectively fired, in which the fluid circulating element is positioned to circulate fluid adjacent to both the first drop ejecting element and the second drop ejecting element.

12 Claims, 7 Drawing Sheets

(56) References Cited

U.S. PATENT DOCUMENTS

| | | | | |
|---|---|---|---|---|
| 8,939,531 | B2 | 1/2015 | Govyadinov et al. | |
| 10,183,493 | B2 | 1/2019 | Govyadinov | |
| 2002/0085076 | A1 | 7/2002 | Romano, Jr. et al. | |
| 2007/0182809 | A1 | 8/2007 | Yarid | |
| 2013/0083136 | A1* | 4/2013 | Govyadinov | B41J 2/1753 347/85 |
| 2013/0155135 | A1 | 6/2013 | Govyadinov et al. | |
| 2013/0182022 | A1 | 7/2013 | Strunk et al. | |
| 2016/0082745 | A1 | 3/2016 | Govyadinov et al. | |

FOREIGN PATENT DOCUMENTS

| | | |
|---|---|---|
| CN | 101568438 | 10/2009 |
| CN | 101835620 | 9/2010 |
| CN | 101959690 | 1/2011 |
| CN | 102985261 | 3/2013 |
| EP | 2334497 | 6/2011 |
| WO | WO-2013162606 | 10/2013 |

* cited by examiner

SELECTIVELY FIRING A FLUID CIRCULATION ELEMENT

BACKGROUND

Fluid ejection devices, such as printheads or dies in inkjet printing systems, typically use thermal resistors or piezoelectric material membranes as actuators within fluidic chambers to eject fluid drops (e.g., ink) from nozzles, such that properly sequenced ejection of ink drops from the nozzles causes characters or other images to be printed on a print medium as the printhead and the print medium move relative to each other. It is typically undesirable to hold ink within the fluidic chambers for prolonged periods of time without either firing or recirculating because the water or other fluid in the ink may evaporate. In addition, when pigment-based inks are held in the fluidic chambers for prolonged periods of time, the pigment may separate from the fluid vehicle in which the pigment is mixed. These issues may result in altered drop trajectories, velocities, shapes and colors, all of which can negatively impact the print quality of a printed image.

BRIEF DESCRIPTION OF THE DRAWINGS

Features of the present disclosure are illustrated by way of example and not limited in the following figure(s), in which like numerals indicate like elements, and in which.

DETAILED DESCRIPTION

Figure 1:
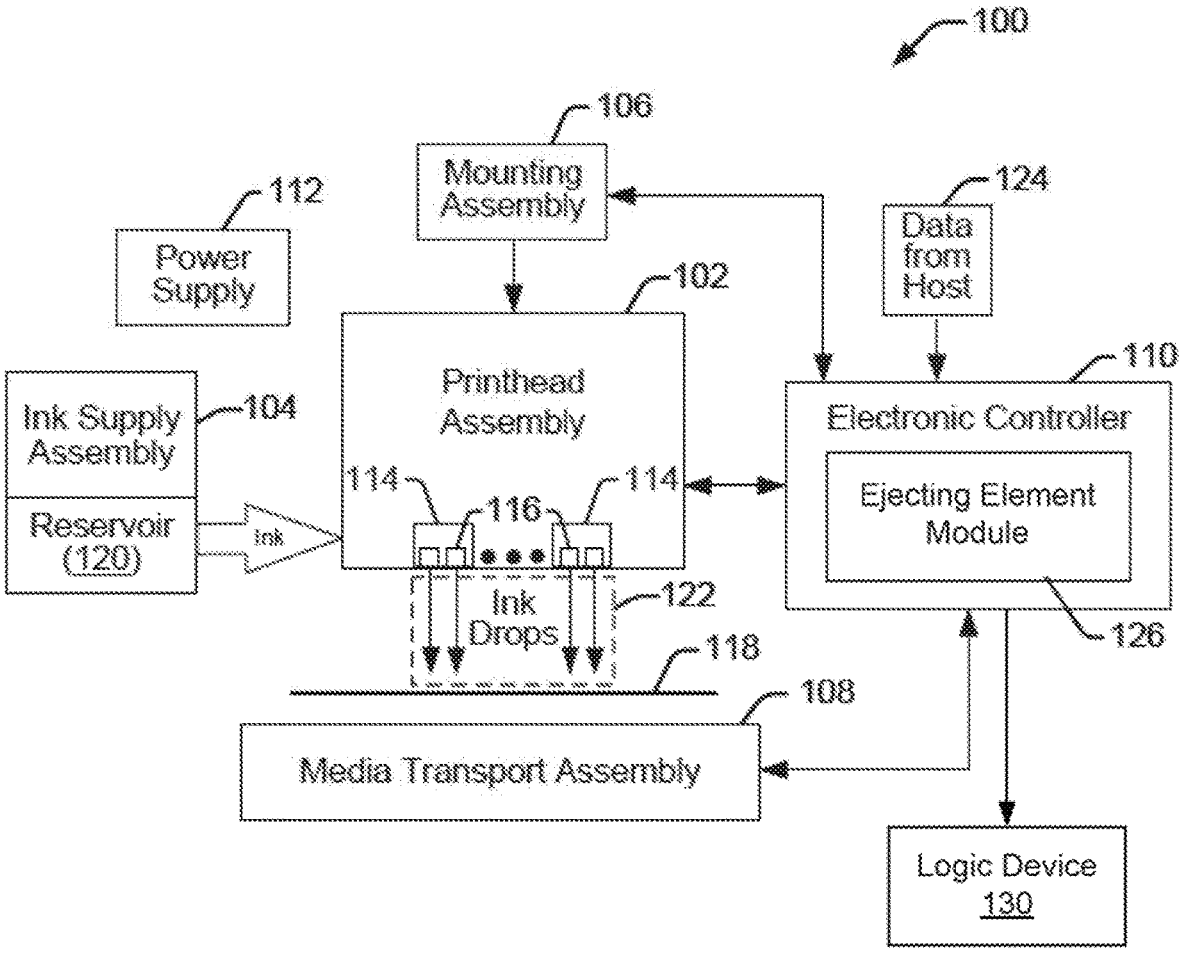
FIG. 1 shows a simplified block diagram of an example printing apparatus having a printhead in which a fluid may be recirculated through firing chambers of the printhead.

As used herein, the terms "a" and "an" are intended to denote at least one of a particular element, the term "includes" means includes but not limited to, the term "including" means including but not limited to, and the term "based on" means based at least in part on. Additionally, It should be understood that the elements depicted in the accompanying figures may include additional components and that some of the components described in those figures may be removed and/or modified without departing from scopes of the elements disclosed herein. It should also be understood that the elements depicted in the figures may not be drawn to scale and thus, the elements may have different sizes and/or configurations other than as shown in the figures.

Disclosed herein is a printing apparatus and methods for selectively activating or firing a fluid circulating element in the printing apparatus, in which the fluid circulating element is to circulate fluid to be delivered by either or both of two drop ejecting elements. That is, the fluid circulating element may be positioned in a fluid ejection device that has a two drop ejecting element to one fluid circulating element ratio, although other ratios may also be employed without departing from the scopes of the methods and printing apparatuses disclosed herein.

In the method, the fluid circulating element may be caused to be selectively fired based upon a determination as to whether either or both of the two drop ejecting elements have been fired within a predetermined period of time prior to a current time. That is, for instance, the fluid circulating element may be caused to be fired only when neither of the drop ejecting elements has been fired within the predetermined period of time. In one regard, the fluid circulating element may be caused to be fired to circulate the fluid in the fluid ejection device when the drop ejecting elements have not been fired for a certain duration of time to ensure that fresh fluid, e.g., ink, is provided in respective fluid chambers of the drop ejecting elements.

In other words, the methods and printing apparatuses disclosed herein may prevent the fluid circulating element from being fired when either of the two drop ejecting elements has been fired within the predetermined period of time. As such, the fluid circulating element may not be fired when the fluid to be ejected by the drop ejecting elements is likely to be fresh, as may occur when any one of the drop ejecting elements is fired. In one regard, therefore, through implementation of the methods and printing apparatuses disclosed herein, the fluid circulating element may not be fired more frequently than may be necessary to keep the fluid ejected by the drop ejecting elements fresh.

According to an example, the determination as to whether the fluid circulating element is to be fired may be made in response to receipt of an instruction to fire one or both of the first drop ejecting element and the second drop ejecting element. In this regard, the fluid circulating element may be fired to refresh the fluid if the fluid may not have been circulated within the predetermined period of time immediately prior to the fluid being ejected by one or both of the first drop ejecting element and the second drop ejecting element.

With reference first to FIG. 1, there is shown a simplified block diagram of an example printing apparatus 100 having a printhead in which a fluid may be recirculated through firing chambers of the printhead. The printing apparatus 100 is depicted as including a printhead assembly 102, an ink supply assembly 104, a mounting assembly 106, a media transport assembly 108, an electronic controller 110, and a power supply 112 that provides power to the various electrical components of the inkjet printing system 100. The printhead assembly 102 is also depicted as including a fluid ejection assembly 114 (or, equivalently, printheads 114) that ejects drops of ink through a plurality of orifices or nozzles 116 toward a print media 118 so as to print on the print media 118.

The print media 118 may be any type of suitable sheet or roll material, such as paper, card stock, transparencies, Mylar, and the like. The nozzles 116 may be arranged in one or more columns or arrays such that properly sequenced ejection of ink from the nozzles 116 causes characters, symbols, and/or other graphics or images to be printed on print media 118 as the printhead assembly 102 and print media 118 are moved relative to each other.

The ink supply assembly 104 may supply fluid ink to the printhead assembly 102 and, in one example, includes a reservoir 120 for storing ink such that ink flows from the reservoir 120 to the printhead assembly 102. The ink supply assembly 104 and the printhead assembly 102 may form a one-way ink delivery system or a recirculating ink delivery system. In a one-way ink delivery system, substantially all of the ink supplied to the printhead assembly 102 is consumed during printing. In a recirculating ink delivery system, only a portion of the ink supplied to printhead assembly 102 is consumed during printing and ink that is not consumed during printing may be returned to the ink supply assembly 104.

In one example, the printhead assembly 102 and the ink supply assembly 104 are housed together in an inkjet cartridge or pen. In another example, the ink supply assembly 104 is separate from printhead assembly 102 and supplies ink to the printhead assembly 102 through an interface connection, such as a supply tube. In either example, the reservoir 120 of ink supply assembly 104 may be removed, replaced, and/or refilled. Where the printhead assembly 102 and the ink supply assembly 104 are housed together in an inkjet cartridge, the reservoir 120 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

The mounting assembly 106 is to position the printhead assembly 102 relative to the media transport assembly 108, and the media transport assembly 108 is to position the print media 118 relative to the printhead assembly 102. Thus, a print zone 122 may be defined adjacent to the nozzles 116 in an area between the printhead assembly 102 and the print media 118. In one example, the printhead assembly 102 is a scanning type printhead assembly. In this example, the mounting assembly 106 includes a carriage for moving the printhead assembly 102 relative to the media transport assembly 108 to scan across the print media 118. In another example, the printhead assembly 102 is a non-scanning type printhead assembly. In this example, the mounting assembly 106 fixes the printhead assembly 102 at a prescribed position relative to the media transport assembly 108. Thus, the media transport assembly 108 may position the print media 118 relative to the printhead assembly 102.

The electronic controller 110 may include a processor, firmware, software, one or more memory components including volatile and non-volatile memory components, and other printer electronics for communicating with and controlling the printhead assembly 102, the mounting assembly 106, and the media transport assembly 108. The electronic controller 110 may receive data 124 from a host system, such as a computer, and may temporarily store the data 124 in a memory (not shown). The data 124 may be sent to the inkjet printing system 100 along an electronic, infrared, optical, or other information transfer path. The data 124 may represent, for example, a document and/or file to be printed. As such, the data 124 may form a print job for the inkjet printing system 100 and may include one or more print job commands and/or command parameters.

In one example, the electronic controller 110 controls the printhead assembly 102 for ejection of ink drops from the nozzles 116. Thus, the electronic controller 110 may define a pattern of ejected ink drops which form characters, symbols, and/or other graphics or images on the print media 118. The pattern of ejected ink drops may be determined by the print job commands and/or command parameters.

The printhead assembly 102 may include a plurality of printheads 114. In one example, the printhead assembly 102 is a wide-array or multi-head printhead assembly. In one implementation of a wide-array assembly, the printhead assembly 102 includes a carrier that carries the plurality of printheads 114, provides electrical communication between the printheads 114 and the electronic controller 110, and provides fluidic communication between the printheads 114 and the ink supply assembly 104.

In one example, the inkjet printing system 100 is a drop-on-demand thermal inkjet printing system in which the printhead 114 is a thermal inkjet (TIJ) printhead. The thermal inkjet printhead may implement a thermal resistor ejection element in an ink chamber to vaporize ink and create bubbles that force ink or other fluid drops out of the nozzles 116. In another example, the inkjet printing system 100 is a drop-on-demand piezoelectric inkjet printing system in which the printhead 114 is a piezoelectric inkjet (PIJ) printhead that implements a piezoelectric material actuator as an ejection element to generate pressure pulses that force ink drops out of the nozzles 116.

According to an example, the electronic controller 110 includes an ejecting element module 126 stored in a memory of the electronic controller 110. The ejecting element module 126 may be a set of instructions and may execute on the electronic controller 110 (i.e., a processor of the electronic controller 110) to control the operation of drop ejecting elements, e.g., thermal resistors, piezoelectric material membranes, or the like, in the printheads 114. In addition, the printing apparatus 100 may include a logic device 130 may control the firing of fluid circulating elements, which may also be thermal resistors, piezoelectric material membranes, or the like, in the printheads 114, as described in greater detail herein below.

Figure 2:
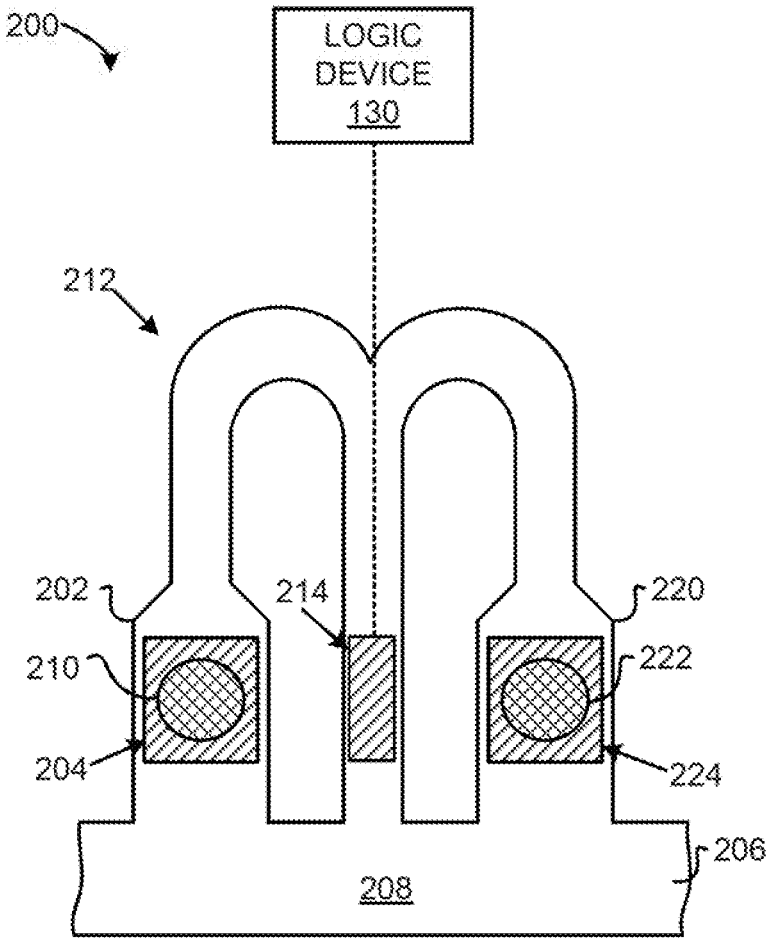
FIG. 2 show a schematic plan view of an example fluid ejection device.

With reference now to FIG. 2, there is shown a schematic plan view of an example fluid ejection device 200. As shown in FIG. 2, the fluid ejection device 200, which may be included in a printhead 114 depicted in FIG. 1, may include a first fluid ejection chamber 202, a first drop ejecting element 204 formed in, provided within, or communicated with the first fluid ejection chamber 202, and a first nozzle or orifice 210. The fluid ejection device 200 may also include a second fluid ejection chamber 220, a second nozzle or orifice 222, and a second drop ejecting element 224. The fluid ejection chambers 202, 220 and the drop ejecting elements 204, 224 may be formed on a substrate 206, which has a fluid (or ink) feed slot 208 formed therein such that the fluid feed slot 208 provides a supply of fluid (or ink) to the fluid ejection chambers 202, 220 and the drop ejecting elements 204, 224. The substrate 208 may be formed, for example, of silicon, glass, a stable polymer, or the like. According to an example, a relatively large number of fluid ejection devices similar to the fluid ejection devices 200 depicted in FIG. 2 may be provided along the substrate 206.

In one example, the fluid ejection chambers 202 and 220 may be formed in or defined by a barrier layer (not shown) provided on the substrate 206, such that the fluid ejection chambers 202 and 220 provide "wells" in the barrier layer. The barrier layer may be formed, for example, of a photo-imageable epoxy resin, such as SU8.

According to an example, a nozzle or orifice layer (not shown) may be formed or extended over the barrier layer such that a first nozzle opening or orifice 210 formed in the orifice layer communicates with the first fluid ejection chamber 202 and a second nozzle opening or orifice 222 communicates with the second fluid ejection chamber 220. The first and second nozzle openings 210, 222 may be of a circular, non-circular, or other shape.

The drop ejecting elements 204, 224 may each be any device that is to eject fluid drops through the respective nozzle openings 210, 222. Examples of suitable drop ejecting elements 210, 222 may include thermal resistors and piezoelectric actuators. A thermal resistor, as an example of a drop ejecting element, may be formed on a surface of a substrate (substrate 206), and may include a thin-film stack including an oxide layer, a metal layer, and a passivation layer such that, when activated, heat from the thermal resistor vaporizes fluid in a fluid ejection chamber 202, thereby causing a bubble that ejects a drop of fluid through the nozzle opening 210. A piezoelectric actuator, as an example of a drop ejecting element, may include a piezoelectric material provided on a moveable membrane communicated with a fluid ejection chamber 202 such that, when activated, the piezoelectric material causes deflection of the membrane relative to the fluid ejection chamber 202, thereby generating a pressure pulse that ejects a drop of fluid through the nozzle opening 210.

As illustrated in FIG. 2, the fluid ejection device 200 may also include a fluid circulation channel 212 and a fluid circulating element 214 formed in, provided within, or communicated with the fluid circulation channel 212. The fluid circulation channel 212 may include a section that is open to and in fluid communication at one end with the fluid feed slot 208. The channel section may also be open to and in fluid communication at an opposite end to the first fluid ejection chamber 202 and the second fluid ejection chamber 220. As shown in FIG. 2, the fluid circulation channel 212 may form a pair of U-shaped channels.

The fluid ejection device 200 depicted in FIG. 2 may thus be construed as having a ratio of two (2) drop ejecting elements to one (1) fluid circulating element. With a 2:1 ratio, circulation may be provided for each of the fluid ejection chambers 202, 220 by the single fluid circulating element 214 in the fluid circulation channel 212. In a further example, the fluid circulating element 214 may instead be positioned on one side of both of the fluid ejection chambers 202, 220.

The fluid circulating element 214 may form or represent an actuator to pump or circulate (or recirculate) fluid through the fluid circulation channel 212 without causing the fluid to be ejected through either of the nozzles 210, 222. Similarly to the first and second drop ejecting elements 204, 224, the fluid circulating element 214 may be a thermal resistor, a piezoelectric actuator, or the like. In one regard, fluid from the fluid feed slot 208 may circulate (or recirculate) through the fluid circulation channel 212 and through the fluid ejection chambers 202 and 220 based on flow induced by the fluid circulating element 214. As such, fluid may circulate (or recirculate) between the fluid feed slot 208 and the fluid ejection chambers 202, 220 through the fluid circulation channel 212. Fluid circulation may also occur in response to either or both of the first and second drop ejecting elements 204, 224 being fired. Circulating (or recirculating) fluid through the fluid ejection chambers 202, 220 may help to reduce ink blockage and/or clogging in the fluid ejection device 200 as well as to keep the fluid in the fluid ejection chambers 202, 220 fresh, i.e., reduce or minimize pigment separation, minimize water evaporation, etc.

Also illustrated in FIG. 2 is a logic device 130, which may be equivalent to the logic device 130 depicted in FIG. 1. As described in greater detail herein below, the logic device 130 may selectively transmit an output signal that is to cause the fluid circulating element 214 to be fired based upon a determination as to whether either or both of the first drop ejecting element 204 and the second drop ejecting element 224 have been fired within a predetermined time period prior to a current time.

The logic device 130 may be integrated into a fluid ejection assembly 114 (or printhead 114) on which the fluid ejection device 200 is provided. That is, for instance, the logic device 130 may include a programmable logic chip or circuit that is integrated into the fluid ejection assembly 114 and is programmed to operate in the manners described below. By way of example, the logic device 130 may be a device on the fluid ejection assembly 114 that is to control energization of the field effect transistors (FETs) that control firing of the drop ejecting elements 204, 224 and the fluid circulating element 214 in the fluid ejection devices 200 of the fluid ejection assembly 114. In another example, the logic device 130 may be equivalent to the electronic controller 110 depicted in FIG. 1 and may thus include instructions stored in a memory that the electronic controller 110 may execute to perform the operations of the logic device 130 described herein. Various manners in which the logic device may operate are described in greater detail herein below.

Although the fluid ejection device 200 has been depicted as having a 2:1 nozzle-to-pump ratio, it should be understood that other nozzle-to-pump ratios (e.g., 3:1, 4:1, etc.) are also possible, where one fluid circulating element 214 induces fluid flow through a fluid circulation channel communicated with multiple fluid ejection chambers and, therefore, multiple nozzle openings or orifices.

In the example illustrated in FIG. 2, the drop ejecting elements 204 and 224 and the fluid circulating element 214 may each be thermal resistors. Each of the thermal resistors may include, for example, a single resistor, a split resistor, a comb resistor, or multiple resistors. A variety of other devices, however, may also be used to implement the drop ejecting elements 204, 224 and the fluid circulating element 214 including, for example, a piezoelectric actuator, an electrostatic (MEMS) membrane, a mechanical/impact driven membrane, a voice coil, a magneto-strictive drive, and so on.

Figure 3A:
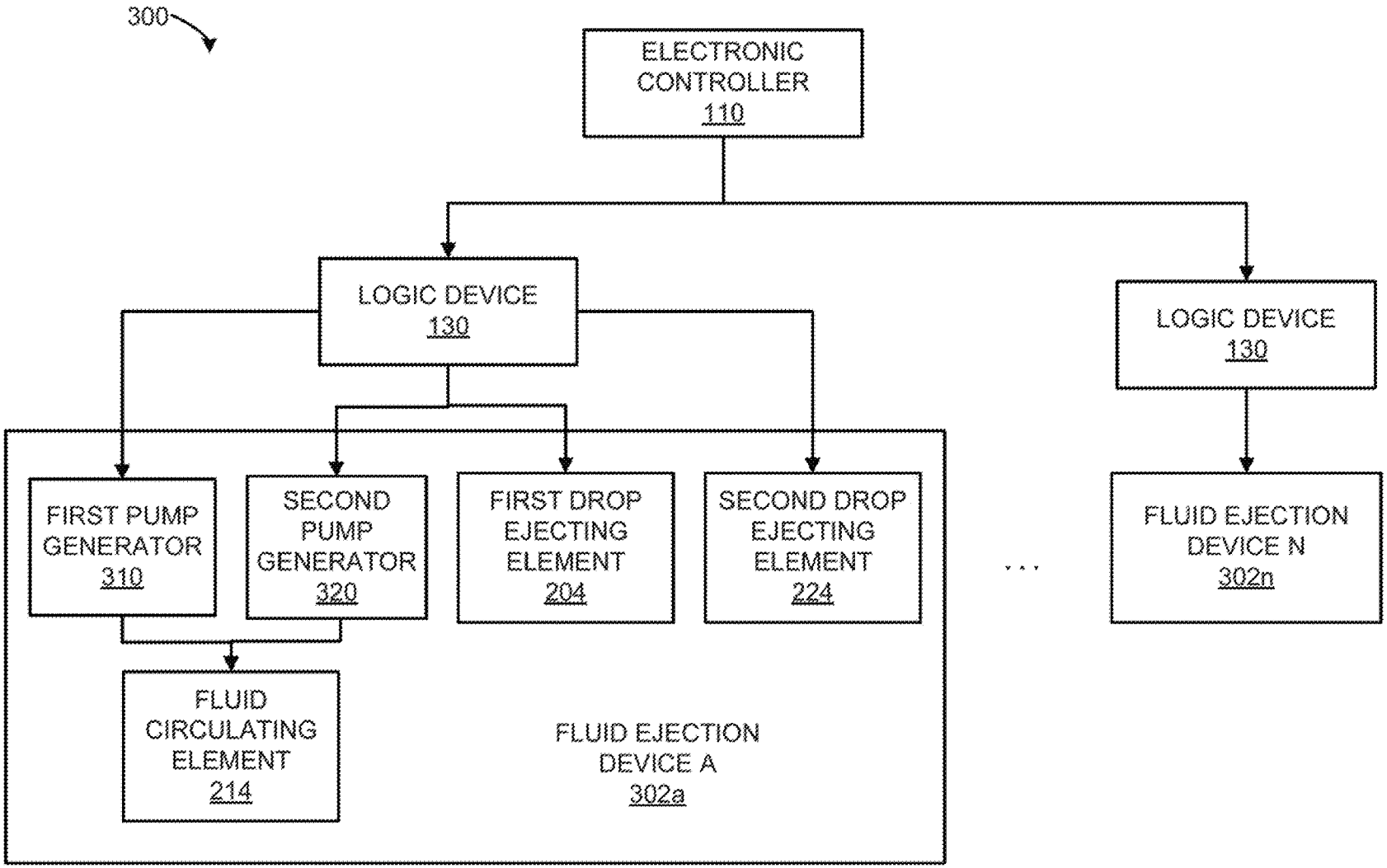
FIGS. 3A and 3B, respectively, show block diagrams of example printing apparatuses that have example fluid ejection devices.
Figure 3B:
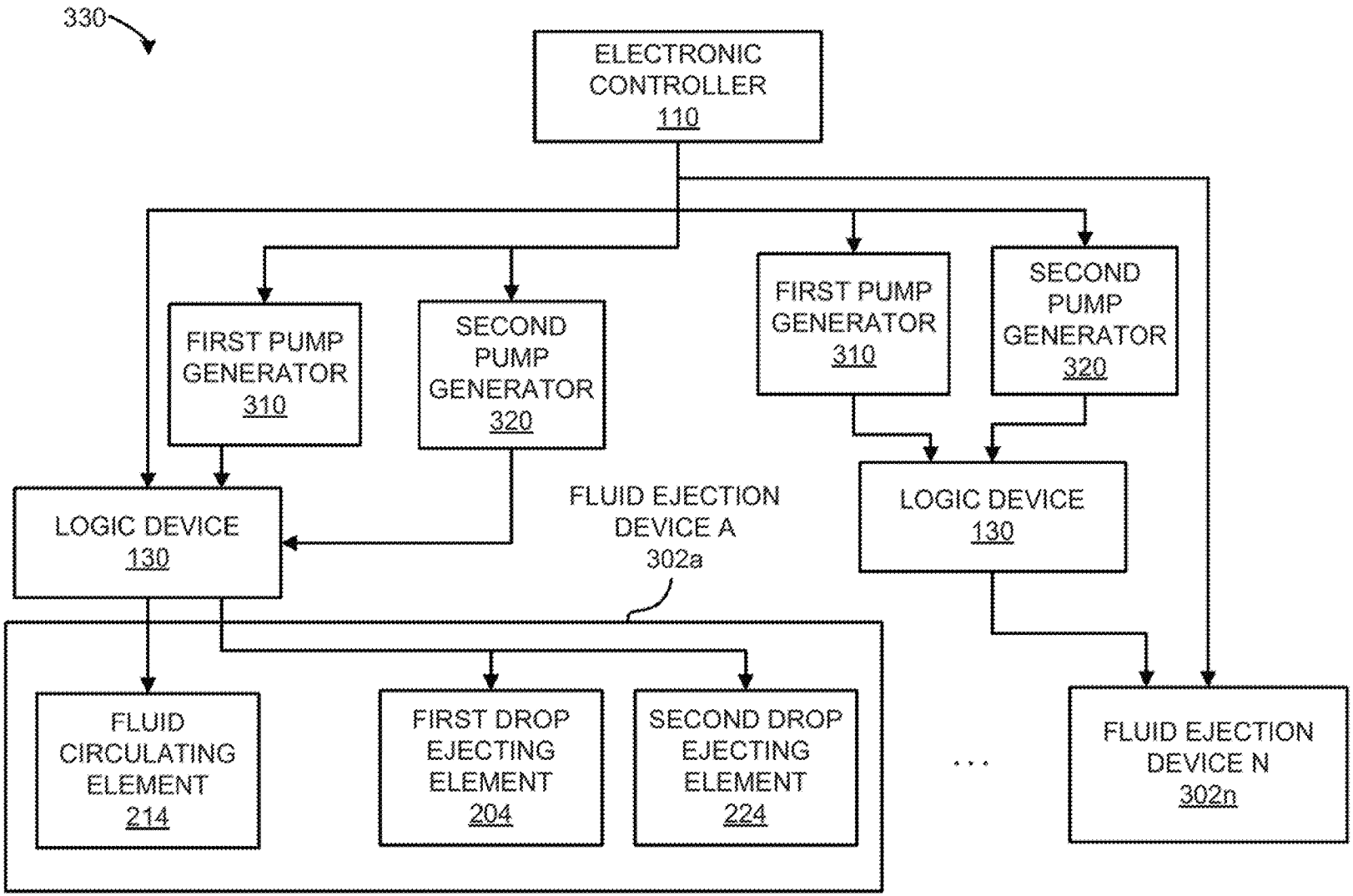

Turning now to FIGS. 3A and 3B, there are respectively shown block diagrams of example printing apparatuses 300 and 330 that have fluid ejection devices. Each of the printing apparatuses 300 and 330 is depicted as including an electronic controller 110 and a plurality of fluid ejection devices 302*a*-302*n*, in which the variable "n" may represent an integer value greater than one. Each of the fluid ejection devices 302*a*-302*n* may be equivalent to the fluid ejection device 200 depicted in FIG. 2. In this regard, each of the fluid ejection devices 302*a*-302*n* may include a first drop ejecting element 204, a second drop ejecting element 224, a fluid circulating element 214, and a logic device 130. Each of the fluid ejection devices 302*a*-302*n* may also include a first pump generator 310 and a second pump generator 320.

As discussed above with respect to FIG. 2, the first drop ejecting element 204, the second drop ejecting element 224, and the fluid circulating element 214 may be in fluid communication with each other through a fluid circulation channel 212. In one regard, the elements 204, 224, and 214 that are in fluid communication with each other through a fluid circulation channel 212 may be construed as a single fluid ejection device 302*a*. As such, for instance, a printhead 114 depicted in FIG. 1 may include a plurality of the fluid ejection devices 302*a*-302*n*. In other examples, however, a fluid ejection device 302*a* may be construed as being formed of a plurality of groups of elements 204, 224, and 214 that are in fluid communication with each other through respective fluid circulation channels 212.

According to an example, the logic device 130 may selectively transmit an output signal that is to cause the fluid circulating element 214 to be fired based upon a determination of the amount of time that has elapsed since either or both of the first drop ejecting element 204 and the second drop ejecting element 224 have been fired. Generally speaking, the logic device 130 may transmit the output signal to cause the fluid circulating element 214 to be fired, for instance, to cause fluid in the fluid chambers 202, 220 to be refreshed. In one example, the logic device 130 may make the determination to transmit the output signal immediately prior to either or both of the first drop ejecting element 204 and the second drop ejecting element 224 being fired. In this regard, the logic device 130 may cause the fluid circulating element 214 to be fired such that fresh fluid is in the fluid chambers 202, 220 when the first drop ejecting element 204 and/or the second drop ejecting element 224 is fired.

However, the logic device 130 may not cause the fluid circulating element 214 to be fired continuously or at a greater frequency than is desired to maintain the fluid being fired at a consistently fresh level. Instead, as discussed in greater detail herein below, the logic device 130 may cause the fluid circulating element 214 to be fired when the logic device 130 determines that neither of the first drop ejecting element 204 and the second drop ejecting element 224 have been fired within a predetermined period of time prior to a current time. That is, when one or both of the first drop ejecting element 204 and the second drop ejecting element 224 are fired, the firing may cause the fluid in the fluid chambers 202, 220 to be recirculated through the fluid circulation channel 212. The fluid in the fluid chambers 202, 220 may thus be refreshed without requiring that the fluid circulating element 214 be fired.

According to an example, the predetermined period of time may be a period of time at which one or more properties of the fluid in the fluid chambers 202, 220 may deteriorate or otherwise result in the fluid having lower quality. That is, as discussed above, the fluid contained in the fluid chambers 202, 220 may deteriorate over time, e.g., may become dry, and the rate at which the fluid deteriorates may vary depending upon the composition of the fluid. Thus, for instance, the predetermined period of time may be determined through testing of the fluid and may vary for different fluids.

According to the example depicted in FIG. 3A, the logic device 130 may transmit the output instruction for the fluid circulating element 214 to be fired to one or both of the first pump generator 310 and the second pump generator 320. The first generator 310 and the second pump generator 320 may each be a hardware device or a set of instructions stored on a hardware memory.

Generally speaking, the first pump generator 310 may generate an output signal (e.g., pump waveform signal) that is to cause the fluid circulating element 214 to be fired responsive to the operations of the first drop ejecting element 204. For instance, the first pump generator 310 may normally be instructed to output a pump waveform signal that is to cause the fluid circulating element 214 to be fired each time the first drop ejecting element 204 is to be fired following the first drop ejecting element 204 reaching an idle state limit (e.g., not being fired for a predetermined period of time). Similarly, the second pump generator 320 may normally be instructed to output a pump waveform signal that is to cause the fluid circulating element 214 to be fired each time the second drop ejecting element 224 is to be fired following the second drop ejecting element 224 reaching an idle state limit (e.g., not being fired for a predetermined period of time).

According to an example, however, instead of operating the first pump generator 310 and the second pump generator 320 in the normal manner described above, the logic device 130 may instruct one of the first pump generator 310 and the second pump generator 320 to generate and output a pump waveform signal in response to neither of the first drop ejecting element 204 and the second drop ejecting element 224 being fired within the predetermined period of time prior to the current time. Likewise, the logic device 130 may prevent both of the first pump generator 310 and the second pump generator 320 from generating and outputting a pump waveform signal in response to either of the first drop ejecting element 204 and the second drop ejecting element 224 being fired within the predetermined period of time prior to the current time. Thus, for instance, the logic device 130 may prevent the first pump generator 310 and the second pump generator 320 from generating and outputting pump waveform signals when recirculation of the fluid is unnecessary.

The printing apparatus 330 depicted in FIG. 3B includes many of the same elements as those shown in the printing apparatus 300 depicted in FIG. 3A. However, in the printing apparatus 330, the logic device 130 is depicted as receiving signals from the first pump generator 310 and the second pump generator 320. That is, the electronic controller 110 may communicate instructions that indicate that the first drop ejecting element 204 and/or the second drop ejecting element 224 are to be fired. In response to those instructions indicating that the first drop ejecting element 204 is to be fired, the first pump generator 310 may determine whether the first drop ejecting element 204 has been idle for a predetermined period of time and if so, may generate and output a pump waveform signal. Likewise, in response to those instructions indicating that the second drop ejecting element 224 is to be fired, the second pump generator 320 may determine whether the second drop ejecting element 224 has been idle for a predetermined period of time and if so, may generate and output a pump waveform signal.

As shown, the logic device 130 may intercept the pump waveform signals outputted from the first pump generator 310 and/or the second pump generator 320. The logic device 130 may determine whether either or both of the first drop ejecting element 204 and the second drop ejecting element 224 have been fired within the predetermined period of time from the current time. In response to a determination that either or both of the first drop ejecting element 204 and the second drop ejecting element 224 have been fired within the predetermined period of time from the current time, the logic device 130 may not communicate either or both of the pump waveform signals received from the first pump generator 310 and the second pump generator 320 to the fluid circulating element 214. That is, for instance, even if the first pump generator 310 generates and outputs a pump waveform signal on the basis that the first drop ejecting element 204 is to be fired following being in the idle state for a predetermined period of time, if the second drop ejecting element 224 has been fired within the predetermined period of time, the logic device 130 may prevent the pump waveform signal from the first pump generator 310 from being communicated to the fluid circulating element 214. Accordingly, the logic device 130 may prevent unnecessary communication of the pump waveform signals as well as the unnecessary firing of the fluid circulating element 214.

In one regard, therefore, the logic device 130 may function as an "OR" circuit or an "NOR" circuit in that the logic device 130 may output the pump waveform signals if neither of the first drop ejecting element 204 and the second drop ejecting element 224 have been fired within the predetermined time period.

Figure 4:
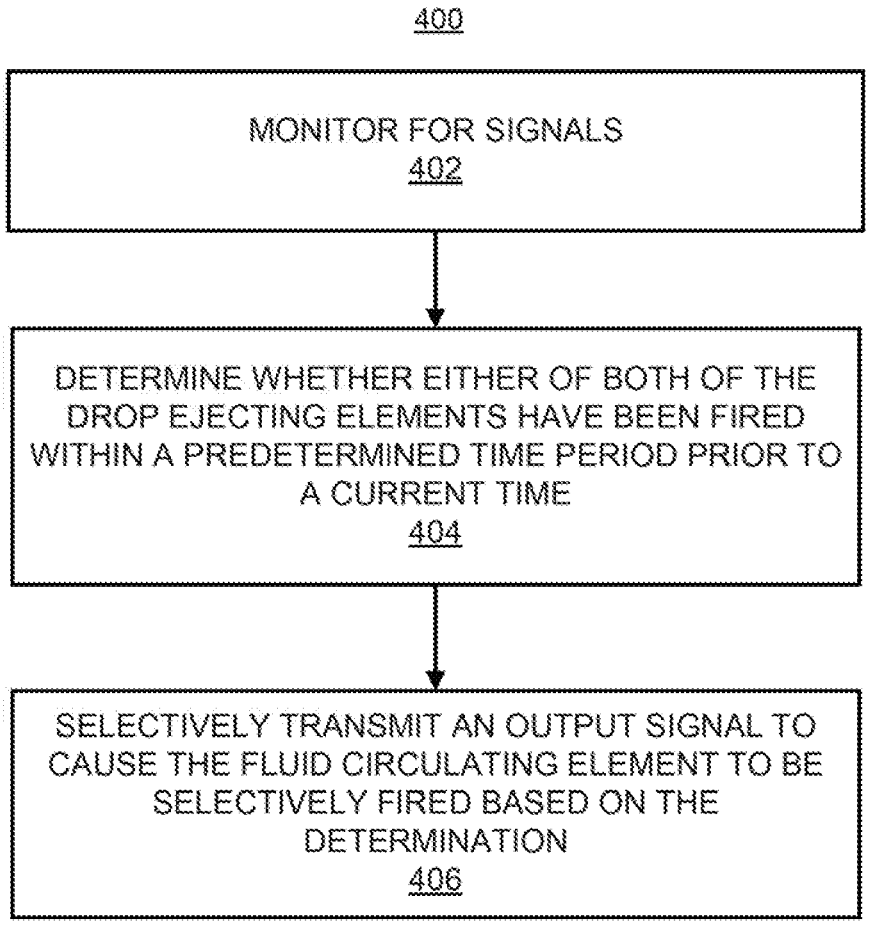
FIGS. 4 and 5, respectively, show flow diagrams of example methods for selectively firing a fluid circulating element.
Figure 5:
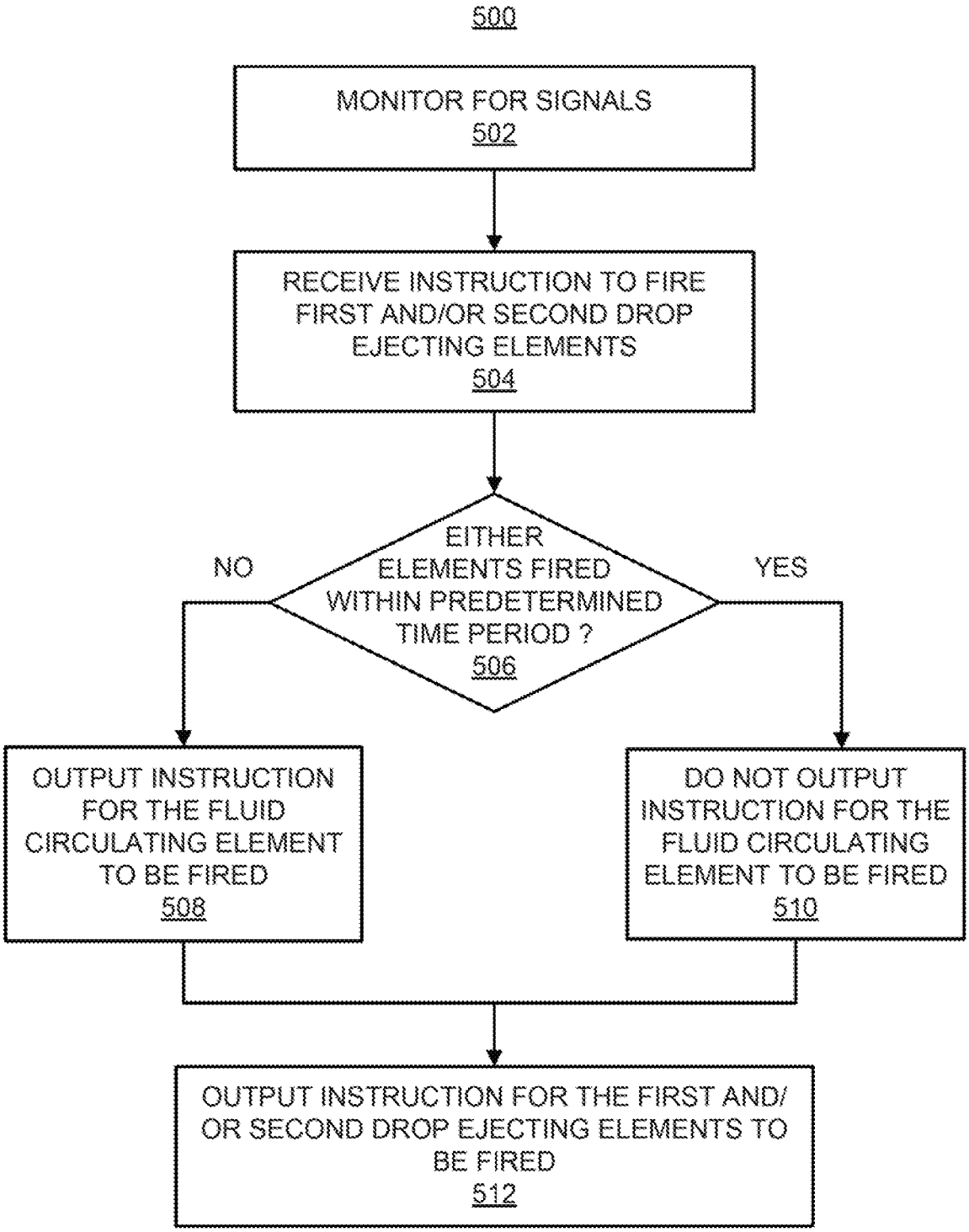

With reference now to FIGS. 4 and 5, there are respectively shown flow diagrams of example methods 400 and 500 for selectively firing a fluid circulating element 214. The method 500 is related to the method 400 in that the method 500 provides additional detail with respect to the features recited in the method 400. It should be understood that the methods 400 and 500 depicted in FIGS. 4 and 5 may include additional operations and that some of the operations described therein may be removed and/or modified without departing from the scopes of the methods 400 and 500. Additionally, it should be understood that the order in which some of the operations in the methods 400 and 500 are implemented may be switched.

The descriptions of the methods 400 and 500 are made with reference to the features depicted in FIGS. 1-38 for purposes of illustration and thus, it should be understood that the methods 400 and 500 may be implemented in printing apparatuses having other configurations. In addition, particular reference is made to a logic device 130 that corresponds to a first fluid ejection device 302*a*. It should, however, be understood that the features recited herein with respect to those elements are also applicable to the remaining fluid ejection devices 302*b*-302*n*.

With reference first to FIG. 4, at block 402, signals indicating whether one or both of a first drop ejecting element 204 and a second drop ejecting element 224 have been fired may be monitored, in which the first drop ejecting element 204 and the second drop ejecting element 224 are in fluid communication with a fluid circulating element 214. For instance, the first drop ejecting element 204, the second drop ejecting element 224, and the fluid circulating element 214 may form part of a 2:1 fluid ejection device 302*a* as discussed above with respect to FIGS. 3A and 3B. Thus, for instance, the fluid circulating element 214 may operate to circulate fluid to be ejected by both of the first drop ejecting element 204 and the second drop ejecting element 224.

By way of example, the logic device 130 may receive information regarding the firing of either or both of the first drop ejecting element 204 and a second drop ejecting element 224 and may store that information. That is, the logic device 130 may receive information from the electronic controller 110 to fire either or both of the first drop ejecting element 204 and the second drop ejecting element 224 and the logic device 130 may store the timing at which the first drop ejecting element 204 and/or the second drop ejecting element 224 are instructed to fire.

At block 404, a determination may be made as to whether either or both of the first drop ejecting element 204 and the second drop ejecting element 224 has been fired within a predetermined time period prior to a current time based on information received from the monitoring. That is, for instance, the logic device 130 may compare a current time to the last time that either of the first drop ejecting element 204 and the second drop ejecting element 224 has been fired and may compare that difference in time to a predetermined time period. The predetermined time period may be a time period over which the fluid contained in the fluid chambers 202, 220 may degrade or otherwise result in lower quality printing and may be based upon the composition of the fluid.

At block 406, the logic device 130 may selectively transmit an output signal to cause the fluid circulating element 214 to be selectively fired based on the determination. For instance, the logic device 130 may transmit an output signal to cause the fluid circulating element 214 to be fired in response to a determination that neither of the first drop ejecting element 204 and the second drop ejecting element 224 has been fired within the predetermined time period. In one example, the output signal may be an instruction signal for one of the first pump generator 310 and the second pump generator 320 to generate a pump waveform signal to be outputted to the fluid circulating element 214 as discussed above with respect to FIG. 3A. In another example, the output signal may be a pump waveform signal received from one of the first pump generator 310 and the second pump generator 320 that the logic device 130 may communicate to the fluid circulating element 214.

Alternatively, however, the logic device 130 may not transmit an output signal to cause the fluid circulating element 214 to be fired in response to a determination that either or both of the first drop ejecting element 204 and the second drop ejecting element 224 have been fired with the predetermined time period.

Turning now to FIG. 5, at block 502, signals indicating whether one or both of a first drop ejecting element 204 and a second drop ejecting element 224 have been fired may be monitored as discussed above with respect to block 402 in FIG. 4. At block 504, the logic device 130 may receive an instruction to fire the first drop ejecting element 204 and/or the second drop ejecting element 224. For instance, the logic device 130 may receive the instruction from the electronic controller 110.

At block 506, in response to receipt of the instruction at block 504, the logic device 130 may determine whether either or both of the first fluid ejection element 204 and the second fluid ejection element 224 have been fired within a predetermined period of time prior to a current time. In response to a determination that neither of the first fluid ejection element 204 or the second fluid ejection element 224 have been fired within the predetermined period of time prior to the current time, at block 508, the logic device 130 may output an instruction for the fluid circulating element 214 to be fired. The logic device 130 may output the instruction in any of the manners discussed above with respect to block 406 in FIG. 4.

However, in response to a determination that either or both of the first drop ejecting element 204 and the second drop ejecting element 224 have been fired within the predetermined period of time, at block 510, the logic device 130 may not output the instruction. This may include the logic device 130 receiving the pump waveform signal or signals from the first pump generator 310 and/or the second pump generator 320 as discussed above with respect to FIG. 3B and not forwarding the received pump waveform signal or signals to the fluid circulating element 214.

Following either of blocks 508 and 510, the logic device 130 may output an instruction for the first drop ejecting element 204 and/or the second drop ejecting element 224 to be fired as indicated at block 512.

Through implementation of either of the methods 400 and 500, for instance, the first drop ejecting element 204 and/or the second drop ejecting element 224 may eject fresh fluid even after being idle for longer than a predetermined time period and without the fluid being refreshed unnecessarily. That is, the fluid may be refreshed when needed and immediately prior to ejection of the fluid.

Some or all of the operations set forth in the methods 400 and 500 may be contained as utilities, programs, or subprograms, in any desired computer accessible medium. In addition, the methods 400 and 500 may be embodied by computer programs, which may exist in a variety of forms both active and inactive. For example, they may exist as machine readable instructions, including source code, object code, executable code or other formats. Any of the above may be embodied on a non-transitory computer readable storage medium.

Examples of non-transitory computer readable storage media include computer system RAM, ROM, EPROM, EEPROM, and magnetic or optical disks or tapes. It is therefore to be understood that any electronic device capable of executing the above-described functions may perform those functions enumerated above.

Figure 6:
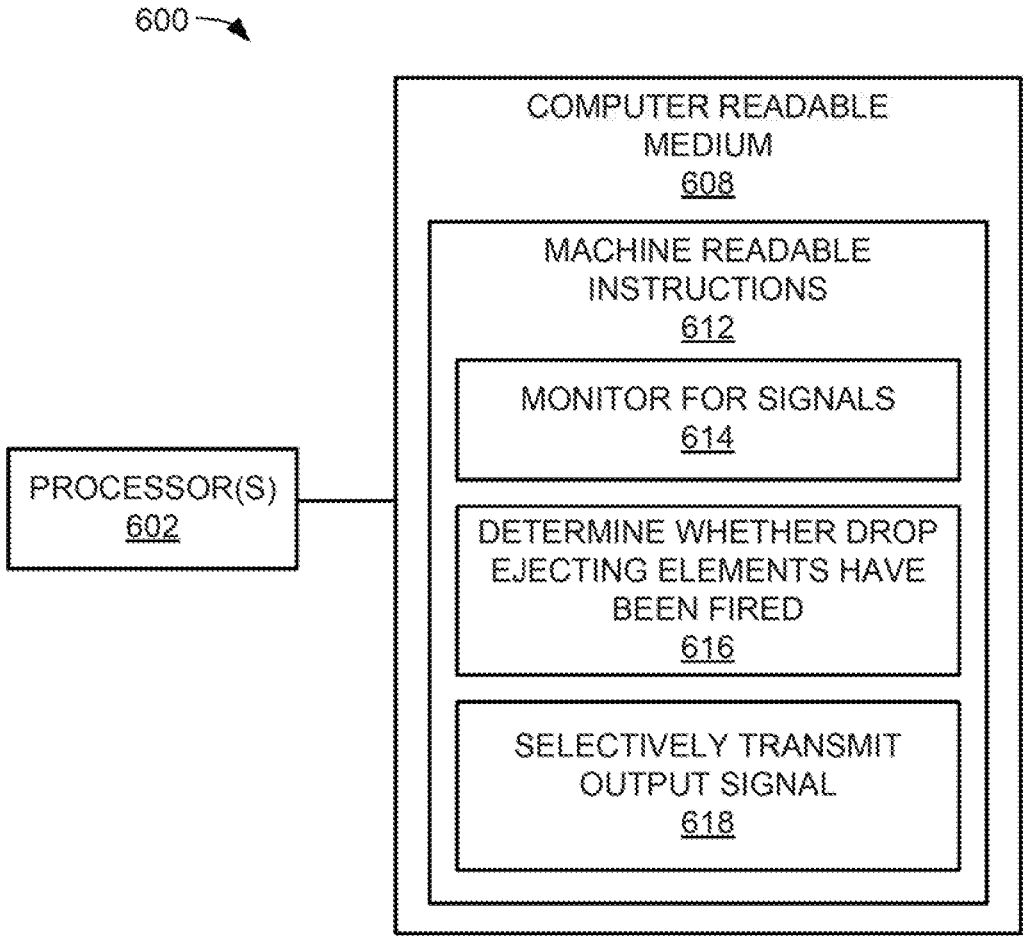
FIG. 6 shows a schematic representation of an example computing device, which may be equivalent to the logic device depicted in FIGS. 3A and 3B.

Turning now to FIG. 6, there is shown a schematic representation of an example computing device 600, which may be equivalent to the logic device 130 depicted in FIGS. 3A and 38. The computing device 600 may include a processor or processors 602 and a computer-readable medium 608.

The computer readable medium 608 may be any suitable medium that participates in providing instructions to the processor 602 for execution. For example, the computer readable medium 608 may be non-volatile media, such as an optical or a magnetic disk; volatile media, such as memory. The computer-readable medium 608 may also store machine readable instructions 612, which, when executed by the processor 602 may cause the processor 602 to perform some or all of the operations in the methods 400 and 500 depicted in FIGS. 4 and 5. Particularly, for instance, the instructions 612 may cause the processor to monitor for signals 614, determine whether either or both of the drop ejecting elements 204, 224 have been fired within a predetermined period of time prior to a current time 616; and selectively transmit an output signal to cause the fluid circulating element to be selectively fired 618.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein are examples of the disclosure along with some variations. The terms, descriptions and figures used herein are set forth by way of illustration and are not meant as limitations. Many variations are possible within the scope of the disclosure, which is intended to be defined by the following claims, and their equivalents, in which all terms are meant in their broadest reasonable sense unless otherwise indicated.

What is claimed is:

1. A printing apparatus comprising:

a fluid ejection device including:

first and second drop ejecting elements positioned inside fluid chambers, a fluid circulating element positioned inside the fluid chambers, wherein the fluid circulating element is to be fired to circulate a fluid inside the fluid chambers, a first pump generator to cause the fluid circulating element to be fired based on operations of the first drop ejecting element, and a second pump generator to cause the fluid circulating element to be fired based on operations of the second drop ejecting element, and a logic device connected to the fluid ejection device, wherein the logic device is to:

in response to a determination that the first drop ejecting element has not been fired for a predetermined period of time, output a first instruction to instruct the first pump generator to fire the fluid circulating element, and in response to a determination that the second drop ejecting element has not been fired for the predetermined period of time, output a second instruction to instruct the second pump generator to fire the fluid circulating element, wherein the logic device is further to determine whether each of the first and second drop ejecting elements has been fired within the predetermined period of time in response to a determination that one of the first and second drop ejecting elements is to be imminently fired.

2. The printing apparatus of claim 1, wherein, following the determination that the first and second drop ejecting elements have not been fired within the predetermined period of time, the logic device causes the fluid circulating element to be fired prior to a firing of one of the first and second drop ejecting elements.

3. The printing apparatus of claim 1, wherein the logic device functions as an OR circuit.

4. The printing apparatus of claim 1, further comprising:

a controller to control a firing of the first drop ejecting element and the second drop ejecting element and send information to the logic device indicating that a firing signal has been sent to either or both of the first drop ejecting element and the second drop ejecting element.

5. The printing apparatus of claim 1, wherein the fluid chambers in the fluid ejection device include:

a first fluid ejection chamber housing the first drop ejecting element, a second fluid ejection chamber housing the second drop ejecting element, and a fluid circulation channel connected to the first fluid ejection chamber, the second fluid ejection chamber, and a fluid feed slot, wherein the fluid circulating element is positioned in the fluid circulation channel to circulate the fluid through the fluid circulation channel, the first fluid ejection chamber, and the second fluid ejection chamber.

6. A method, comprising:

determining, by a logic device connected to a fluid ejection device, that a first drop ejecting element and a second drop ejecting element in fluid chambers of the fluid ejection device have not been fired within a predetermined time period based on information received from monitoring signals sent to the first drop ejecting element and the second drop ejecting element;

in response to the determination that the first drop ejecting element has not been fired within the predetermined time period, outputting, by the logic device, a first instruction to instruct a first pump generator of the fluid ejection device to generate a first pump waveform signal to cause a fluid circulating element in the fluid chambers to be fired to circulate a fluid in the fluid chambers of the fluid ejection device;

in response to the determination that the second drop ejecting element has not been fired within the predetermined time period, outputting, by the logic device, a second instruction to instruct a second pump generator in the fluid ejection device to generate a second pump waveform signal to cause the fluid circulating element to be fired to circulate the fluid in the fluid chambers of the fluid ejection device; and following the determination that the first drop ejecting element and the second drop ejecting element have not been fired within the predetermined time period, outputting, by the logic device, the first instruction to instruct the first pump generator to generate the first pump waveform signal to cause the fluid circulating element to be fired immediately prior to the first drop ejecting element being fired.

7. The method of claim 6, further comprising:

controlling, by a controller, a firing of the first drop ejecting element and the second drop ejecting element; and transmitting, by the controller, information to the logic device indicating that a firing signal has been sent to the first drop ejecting element and the second drop ejecting element.

8. The method of claim 6, further comprising:

determining whether one of the first drop ejecting element and the second drop ejecting element was fired within the predetermined time period; and based on a determination that one of the first drop ejecting element and the second drop ejecting element was fired within the predetermined time period, preventing the first pump waveform signal and the second pump waveform signal from being transmitted to the fluid circulating element.

9. The method of claim 6, further comprising:

receiving an indication that the first drop ejecting element or the second drop ejecting element is to be fired imminently; and in response to the indication that the first drop ejecting element or the second drop ejecting element is to be fired imminently, preventing the outputting of the first pump waveform signal and the second pump waveform signal to prevent the fluid circulating element from being fired.

10. A non-transitory computer readable storage medium comprising machine readable instructions that when executed by a processor of a logic device, cause the processor of the logic device to:

determine that a first drop ejecting element and a second drop ejecting element in fluid chambers of a fluid ejection device have not been fired within a predetermined time period based on information received from monitoring signals sent to the first drop ejecting element and the second drop ejecting element;

in response to the determination that the first drop ejecting element has not been fired within the predetermined time period, output a first instruction to instruct a first pump generator located in the fluid ejection device to generate a first pump waveform signal to cause a fluid circulating element in the fluid chambers to be fired to circulate a fluid in the fluid chambers of the fluid ejection device;

in response to the determination that the second drop ejecting element has not been fired within the predetermined time period, output a second instruction to instruct a second pump generator in the fluid ejection device to generate a second pump waveform signal to cause the fluid circulating element to be fired to circulate the fluid in the fluid chambers of the fluid ejection device;

determine whether one of the first drop ejecting element and the second drop ejecting element was fired within the predetermined time period; and based on a determination that one of the first drop ejecting element and the second drop ejecting element was fired within the predetermined time period, prevent the first pump waveform signal and the second pump waveform signal from being transmitted to the fluid circulating element.

11. The non-transitory computer readable storage medium of claim 10, wherein the instructions further cause the processor to:

following the determination that the first drop ejecting element and the second drop ejecting element have not been fired within the predetermined time period, output the first instruction to instruct the first pump generator to generate the first pump waveform signal to cause the fluid circulating element to be fired immediately prior to the first drop ejecting element being fired.

12. The non-transitory computer readable storage medium of claim 10, wherein the instructions further cause the processor to:

receive an indication that the first drop ejecting element or the second drop ejecting element is to be fired imminently; and in response to the indication that the first drop ejecting element or the second drop ejecting element is to be fired imminently, prevent the first pump generator from generating the first pump waveform signal and the second pump generator from generating the second pump waveform signal to prevent the fluid circulating element from being fired.

* * * * *